US010749293B2

(12) United States Patent
Oishi et al.

(10) Patent No.: US 10,749,293 B2
(45) Date of Patent: Aug. 18, 2020

(54) CONNECTOR

(71) Applicant: Yazaki Corporation, Tokyo (JP)

(72) Inventors: Kozo Oishi, Utsunomiya (JP); Tomoyuki Miyakawa, Utsunomiya (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/238,912

(22) Filed: Jan. 3, 2019

(65) Prior Publication Data

US 2019/0140391 A1 May 9, 2019

Related U.S. Application Data

(63) Continuation of application No. PCT/JP2017/021827, filed on Jun. 13, 2017.

(30) Foreign Application Priority Data

Jul. 12, 2016 (JP) ..... 2016-137219

(51) Int. Cl.
*H01R 13/52* (2006.01)
*H01R 13/64* (2006.01)
(Continued)

(52) U.S. Cl.
CPC ..... *H01R 13/5221* (2013.01); *H01R 13/50* (2013.01); *H01R 13/6272* (2013.01);
(Continued)

(58) Field of Classification Search
CPC .. H01R 13/5221; H01R 13/50; H01R 13/631; H01R 13/64
(Continued)

(56) References Cited

U.S. PATENT DOCUMENTS 6,527,579 B2 * 3/2003 Sato ..... H01R 13/4364 439/352
8,454,378 B2 * 6/2013 Osterhart ..... H01R 13/4223 439/284
(Continued)

FOREIGN PATENT DOCUMENTS

EP 1 049 214 A1 11/2000
EP 1 764 877 A1 3/2007
(Continued)

OTHER PUBLICATIONS

International Search Report (PCT/ISA/210) dated Aug. 8, 2017 issued by the International Searching Authority in International Application No. PCT/JP2017/021827.
(Continued)

*Primary Examiner* — Alexander Gilman
(74) *Attorney, Agent, or Firm* — Sughrue Mion, PLLC

(57) ABSTRACT

A connector includes a pair of housings to be fitted to each other by inserting an insertion part of one housing into a tubular part of another housing. On an outer peripheral surface of the insertion part of the one housing, a plurality of outer ribs which project from the outer peripheral surface are provided separately in a circumferential direction to extend from a front end of the insertion part to a rear side. On an inner peripheral surface of the tubular part of the other housing, a plurality of inner ribs which project from the inner peripheral surface are provided separately in a circumferential direction to extend from a front end of the tubular part to a rear side. The outer ribs and the inner ribs are provided such that positions in the circumferential direction are deviated from each other.

4 Claims, 13 Drawing Sheets

(51) Int. Cl.

| | |
|---|---|
| ***H01R 13/50*** | (2006.01) |
| ***H01R 13/627*** | (2006.01) |
| ***H01R 13/631*** | (2006.01) |
| *H01R 13/629* | (2006.01) |
| *H01R 13/422* | (2006.01) |
| *H01R 43/18* | (2006.01) |

(52) U.S. Cl.
CPC ..... *H01R 13/631* (2013.01); *H01R 13/64* (2013.01); *H01R 13/4223* (2013.01); *H01R 13/5219* (2013.01); *H01R 13/629* (2013.01); *H01R 43/18* (2013.01)

(58) Field of Classification Search
USPC ..... 439/283
See application file for complete search history.

(56) References Cited

U.S. PATENT DOCUMENTS

| | | | | |
|---|---|---|---|---|
| 9,979,125 | B2 * | 5/2018 | Hamada | H01R 13/5221 |
| 10,205,269 | B2 * | 2/2019 | Hirota | H01R 13/5221 |
| 10,224,665 | B2 * | 3/2019 | Iida | H01R 13/501 |
| 2006/0003631 | A1 * | 1/2006 | Fukatsu | H01R 13/4364 439/595 |
| 2008/0064250 | A1 * | 3/2008 | Lee | H01R 13/6277 439/352 |
| 2009/0117770 | A1 * | 5/2009 | Fukui | H01R 13/4364 439/345 |

FOREIGN PATENT DOCUMENTS

| | | | |
|---|---|---|---|
| GB | 2 454 358 | A | 5/2009 |
| JP | 59-008297 | Y2 | 3/1984 |
| JP | 09-306592 | A | 11/1997 |
| JP | 2002-198127 | A | 7/2002 |
| JP | 2011-82114 | A | 4/2011 |
| JP | 2011-086544 | A | 4/2011 |
| JP | 2013-239369 | A | 11/2013 |

OTHER PUBLICATIONS

Written Opinion (PCT/ISA/237) dated Aug. 8, 2017 issued by the International Searching Authority in International Application No. PCT/JP2017/021827.

International Preliminary Report on Patentability, including translation of Written Opinion, dated Jan. 15, 2019 by the International Searching Authority in International Patent Application No. PCT/JP2017/021827.

Communication dated May 10, 2019 issued by the European Intellectual Property Office in counterpart European Application No. 17827314.0.

* cited by examiner

CONNECTOR

CROSS-REFERENCES TO RELATED APPLICATIONS

This application is a continuation of International Application No. PCT/JP2017/021827 filed on Jun. 13, 2017 based on Japanese Patent Application No. 2016-137219 filed on Jul. 12, 2016, the contents of which are incorporated herein by reference.

TECHNICAL FIELD

The present invention relates to a connector.

BACKGROUND ART

A connector of JP-A-2013-239369 includes a pair of housings in which an insertion part of one housing is inserted and fitted to a tubular part of the other housing. In such a kind of connector, the clearance (gap) between the outer peripheral surface of the insertion part and the inner peripheral surface of the tubular part is properly set to regulate looseness between the housings.

SUMMARY

In the connector of JP-A-2013-239369, typically, the clearance between the outer peripheral surface of the insertion part and the inner peripheral surface of the tubular part is set properly. However, depending on the clearance, the insertion part of one housing may be inserted with a relatively inclined posture into the tubular part of the other housing. In that case, there is a risk of affecting the contact between terminals of a female terminal supported by one of the insertion part and the tubular part and a male terminal supported by the other.

The invention has been made in consideration of the above problem, and an object thereof is to control the inclination of the housings during insertion.

The above-described problem according to the invention is solved by the following configuration.

(1) A connector includes: a pair of housings to be fitted to each other by inserting an insertion part of one housing into a tubular part of another housing. On an outer peripheral surface of the insertion part of the one housing, a plurality of outer ribs which project from the outer peripheral surface are provided separately in a circumferential direction to extend from a front end of the insertion part to a rear side. On an inner peripheral surface of the tubular part of the other housing, a plurality of inner ribs which project from the inner peripheral surface are provided separately in a circumferential direction to extend from a front end of the tubular part to a rear side. The outer ribs and the inner ribs are provided such that positions in the circumferential direction are deviated from each other.

According to the connector configured as (1), even if the insertion part is inserted with a relatively inclined posture into the tubular part, the outer rib of the insertion part contacts with the inner peripheral surface of the front end part of the tubular part, and the inner rib of the tubular part contacts with the outer peripheral surface of the front end part of the insertion part, thereby controlling the inclination of the insertion part. Accordingly, the inclination of the insertion part is corrected at an initial insertion stage. Thus, for example, the male terminal can be smoothly picked up by the female terminal, and the excellent contact between the terminals can be secured. In addition, as the ribs are provided in the outer peripheral surface of the insertion part and the inner peripheral surface of the tubular part, it is possible to reduce a friction between the insertion part and the tubular part. Accordingly, although the clearance between the outer peripheral surface of the insertion part and the inner peripheral surface of the tubular part is small, the increase of the insertion load of the insertion part with respect to the tubular part can be prevented. In that case, for example, the projection height of the outer rib and the inner rib is preferably set to a height that the ribs do not contact with the outer peripheral surface of the insertion part or the inner peripheral surface of the tubular part while fitting the pair of housings. In addition, the inclined surface of which the height is lowered toward the front end of the housing may be formed in each front end part of the outer rib and the inner rib. Accordingly, the inclination of the insertion part inserted into the tubular part can be smoothly corrected by the inclined surface of the inner rib or the outer rib.

(2) The connector according to (1), the outer ribs are arranged at positions which are plane-symmetrical to a plane passing through a geometric center of the outer peripheral surface of the insertion part, and the inner ribs are arranged at positions which are plane-symmetrical to a plane passing through a geometric center of the inner peripheral surface of the tubular part. According to the connector configured as (1), it is possible to prevent the eccentricity of the insertion part and the tubular part which occurs from uneven contact between the insertion part and the tubular part in the circumferential direction. Accordingly, it is possible to prevent the positional deviation between the terminals which occurs from the eccentricity and to maintain the excellent contact between the terminals.

(3) The connector according to (1) or (2), the outer ribs are formed in a stepped shape having an increased projection height from a position separated by a set distance from the front end of the insertion part to the rear side, or the inner ribs are formed in a stepped shape having an increased projection height from a position separated by a set distance from the front end of the tubular part to the rear side. According to the connector configured as (3), the clearance between the insertion part and the tubular part can be reduced (for example, minimized) by a rear step portion of the rib which is formed with a high projection height in a stepped shape. Accordingly, it is possible to prevent the increase of the insertion load of the insertion part and to control the looseness while completely fitting the housings.

(4) The connector according to any one of (1) to (3), the pair of housings include: cavities, each of which houses a terminal and; and a pair of resin tubular bodies which are supported by the housings such that openings of the cavities are positioned inside the tubular bodies and which are fitted to each other. An annular protrusion is provided over an entire periphery on one surface of surfaces of the pair of cylindrical bodies which face each other when the pair of tubular bodies are fitted, and contacts another surface of the surfaces. The annular protrusion includes an inclined surface which is lowered from a front end side of the tubular body toward a rear end side.

According to the connector configured as (4), for example, the annular protrusion of one tubular body can be pushed to be brought into contact with the facing surface of the other tubular body while fitting the pair of tubular bodies. Accordingly, it is possible to improve the waterproofness in the cavity by the pair of tubular bodies.

By the way, in such a tubular body, the annular protrusion is provided during resin molding in the pulling-out direction of a mold. Thus, there is room for improvement in that the annular protrusion is easily caught by the mold during mold release. In this point, the configuration of (4), the annular protrusion is formed to have the inclined surface which is lowered from the front end side of the tubular body toward the rear end side. Thus, it is possible to pull out the mold along the inclined surface of the annular protrusion and to prevent the mold from being caught by the annular protrusion. Therefore, the shape of the annular protrusion during molding can be well maintained.

According to an aspect of the invention, it is possible to control the inclination of the housing during insertion.

BRIEF DESCRIPTION OF THE DRAWINGS

FIGS. 13A and 13B are views for explaining a second embodiment of the invention; wherein FIG. 13A illustrates a female-side tubular body, and FIG. 13B illustrates a male-side tubular body.

FIGS. 14A and 14B are views for explaining a third embodiment of the invention; wherein FIG. 14A is a view obtained by lengthening the entire length of the male-side tubular body compared to FIG. 14B.

DETAILED DESCRIPTION

First Embodiment

Figure 1:
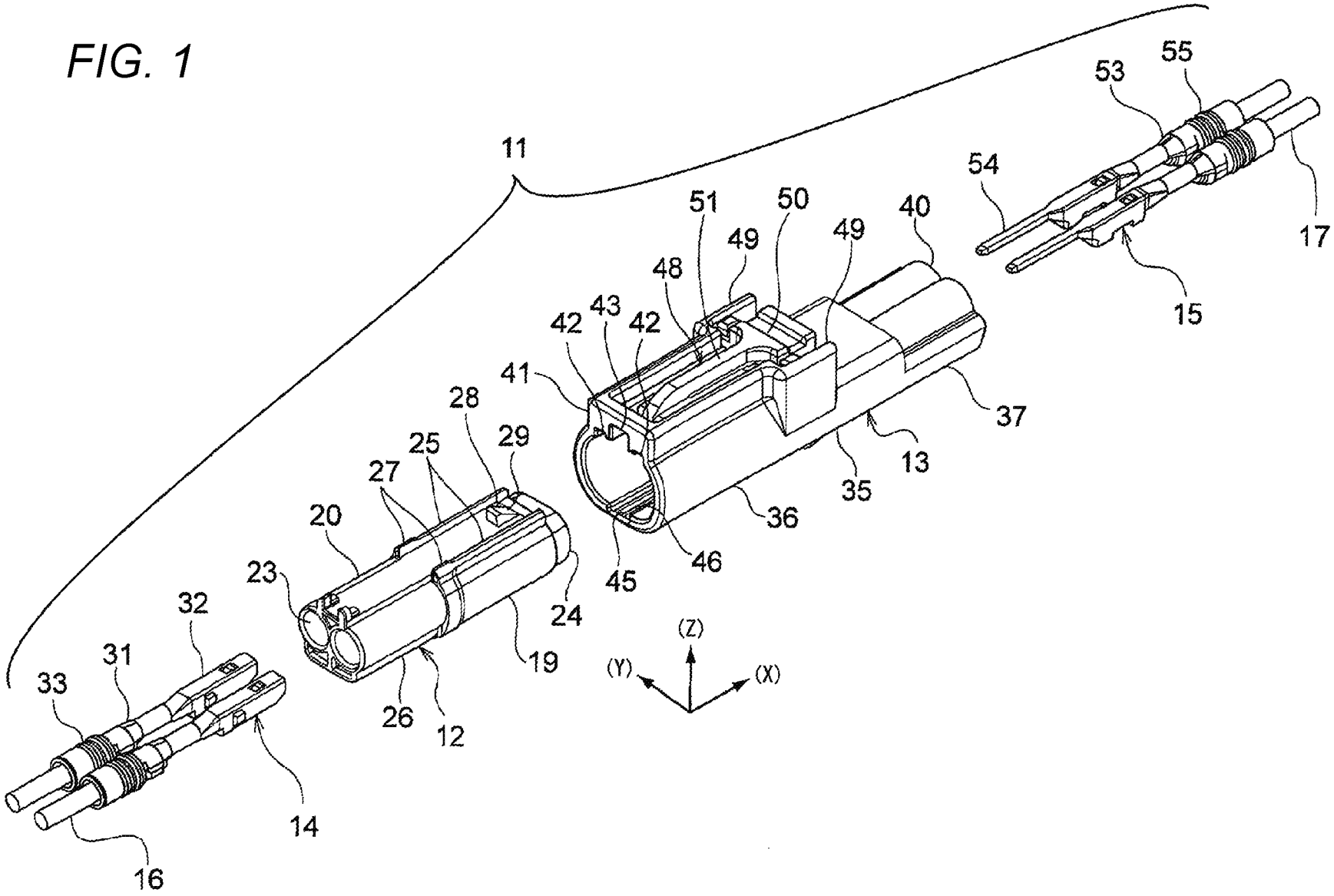
FIG. 1 is an exploded perspective view of a connector in a first embodiment of the invention.

Hereinafter, a first embodiment of a connector according to the invention will be described with reference to the drawings. As illustrated in FIG. 1, a connector 11 of the first embodiment includes a female housing 12 (one housing) and a male housing 13 (other housing) which are fitted into each other. The connector 11 is configured such that a female terminal 14 housed in the female housing 12 and a male terminal 15 housed in the male housing 13 are electrically connected by fitting the female housing 12 and the male housing 13. Electric wires 16 and 17 are connected with the female terminal 14 and the male terminal 15, respectively. The female housing 12 is configured to be fitted and locked to the inside of the male housing 13 when fitted into the male housing 13. In FIG. 1, each housing houses two terminals. However, the number of the housed terminals is not limited to two. Incidentally, hereinafter, the description will be given with a definition in which an X direction of FIG. 1 is a front and rear direction, a Y direction is a width direction, a Z direction is a height direction, the fitting direction of each connector is the front direction, and the upper side of FIG. 1 is the upside.

Figure 2:
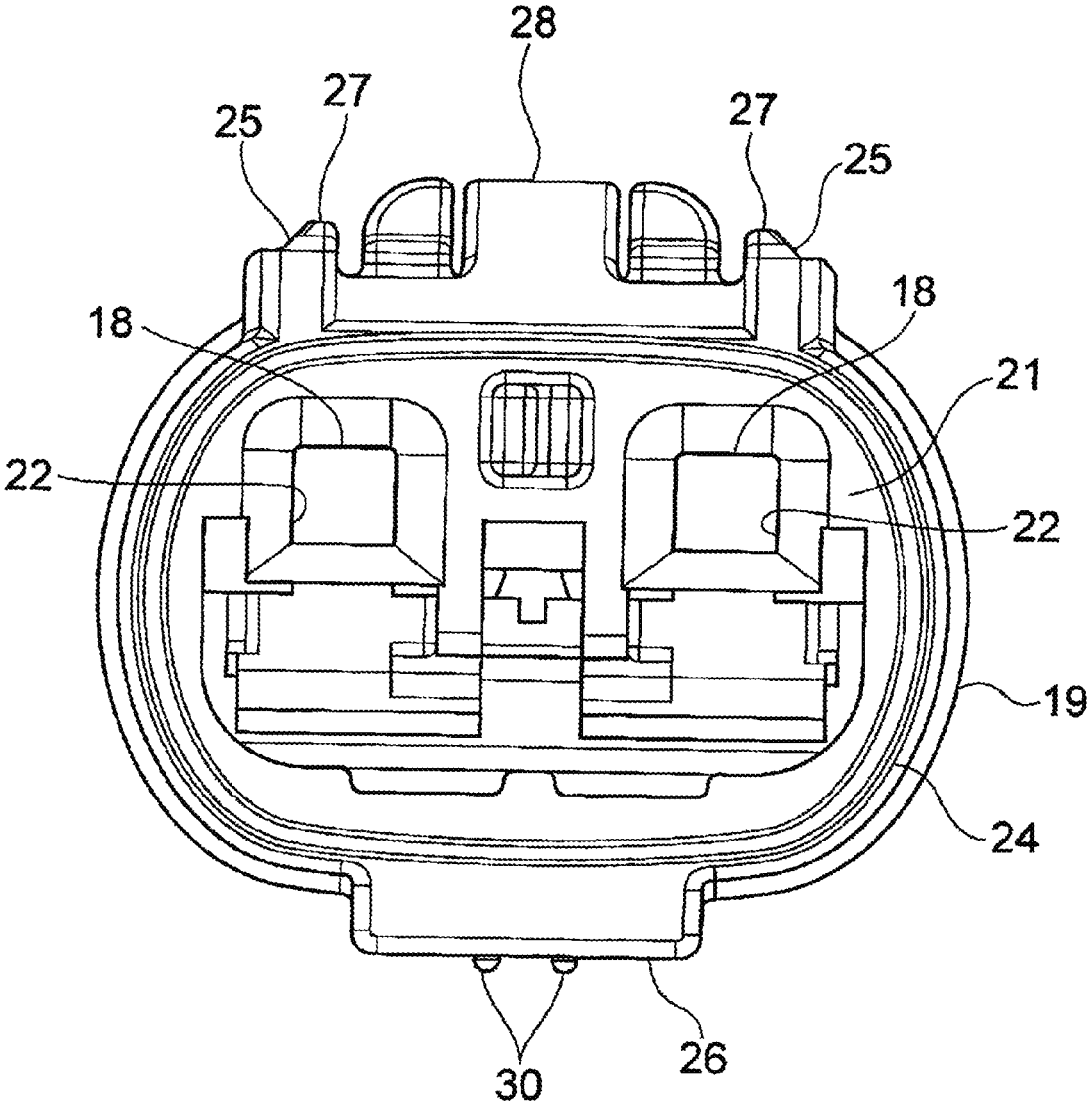
FIG. 2 is a front view illustrating a female housing when viewed from the front side.

The female housing 12 is made of an insulating synthetic resin, and the cross section orthogonal to the front and rear direction is formed in an oval tubular shape having a longer side in the width direction as illustrated in FIGS. 1 and 2. The female housing 12 is integrally provided with a base part 19 inside which two cavities 18 and 18 housing the female terminal 14 and extending in the front and rear direction are formed and an electric wire holding part 20 which projects from the base part 19 to the rear side, and is formed symmetrically.

As illustrated in FIG. 2, the cavities 18 are arranged adjacently in the width direction of the base part 19 and are symmetrically formed to be partitioned with each other. A lance (not illustrated) extending to the front side is provided inside the cavity 18, and each female terminal 14 is locked by the lance, so as to hold each female terminal 14 at a set position in the cavity 18. The cavity 18 is open to the front side through an opening 22 of a front end surface 21 of the base part 19 and is open to the rear side to communicate with an electric wire insertion hole 23 (see FIG. 1) penetrating the electric wire holding part 20 in the front and rear direction.

In the base part 19, the opening 22 of the cavity 18 is positioned inside a cylindrical female-side tubular body 24 which is supported by the front end surface 21 and is provided to project to the front side. The female-side tubular body 24 is made of an insulating synthetic resin and is formed integrally with the base part 19. The outer peripheral surface of the female-side tubular body 24 is formed small in a stepped shape over the entire periphery together with the outer peripheral surface of the base part 19. The base part 19 is formed integrally with a pair of projection parts 25 and 25 which project from the upper portion of the outer peripheral surface to the upper side and extend in the front and rear direction and a swelling part 26 which projects from the lower portion of the outer peripheral surface to the lower side and extends in the front and rear direction. The pair of projection parts 25 and 25 are provided to extend along from the front end of the base part 19 to the rear end and to be separated from each other in the width direction. The upper surface thereof is provided with first ribs 27 and 27 which project to the upper side along the front and rear direction. A lock part 28 projecting to the upper side is provided inside the pair of projection parts 25 and 25. The lock part 28 is provided with an inclined surface 29 which is lowered toward the front side. The swelling part 26 extends from the front end of the base part 19 to the rear end and is formed in a rectangular sectional shape. The lower surface thereof is provided with a pair of second ribs 30 and 30 which project to the lower side along the front and rear direction. Incidentally, the first rib 27 and the second rib 30 will be described in detail below.

As illustrated in FIG. 1, the female terminal 14 is formed of a conductive metal plate material or the like and is formed integrally with an electric wire connection part 31 which crimps and connects the core wire of the electric wires 16 and a rectangular tubular electric contact part 32. An annular rubber plug 33 is mounted on the outer peripheral surface of the electric wires 16 of which one end is connected with the electric wire connection part 31. The female terminal 14 is inserted from the rear side into the electric wire insertion hole 23 of the electric wire holding part 20, and the rubber plug 33 is pushed into the electric wire insertion hole 23. Accordingly, the rubber plug 33 is brought into close contact with each of the outer peripheral surface of the electric wires 16 and the inner peripheral surface of the electric wire insertion hole 23, so as to seal the opening of the electric wire insertion hole 23. In the female terminal 14 which is inserted from the electric wire insertion hole 23 to be held at a predetermined position in the cavity 18, a tip part of the electric contact part 32 is arranged at a position which is retreated by a set distance from the opening 22 of the base part 19.

As illustrated in FIG. 1, the male housing 13 is made of an insulating synthetic resin and is provided with a tubular housing body 35 inside which two cavities 34 and 34 which houses the male terminal 15 and extends in the front and rear direction are formed, a hood part 36 which projects from the housing body 35 to the front side, and an electric wire holding part 37 which projects from the housing body 35 to the rear side in a symmetrical and integrated manner.

Figure 3:
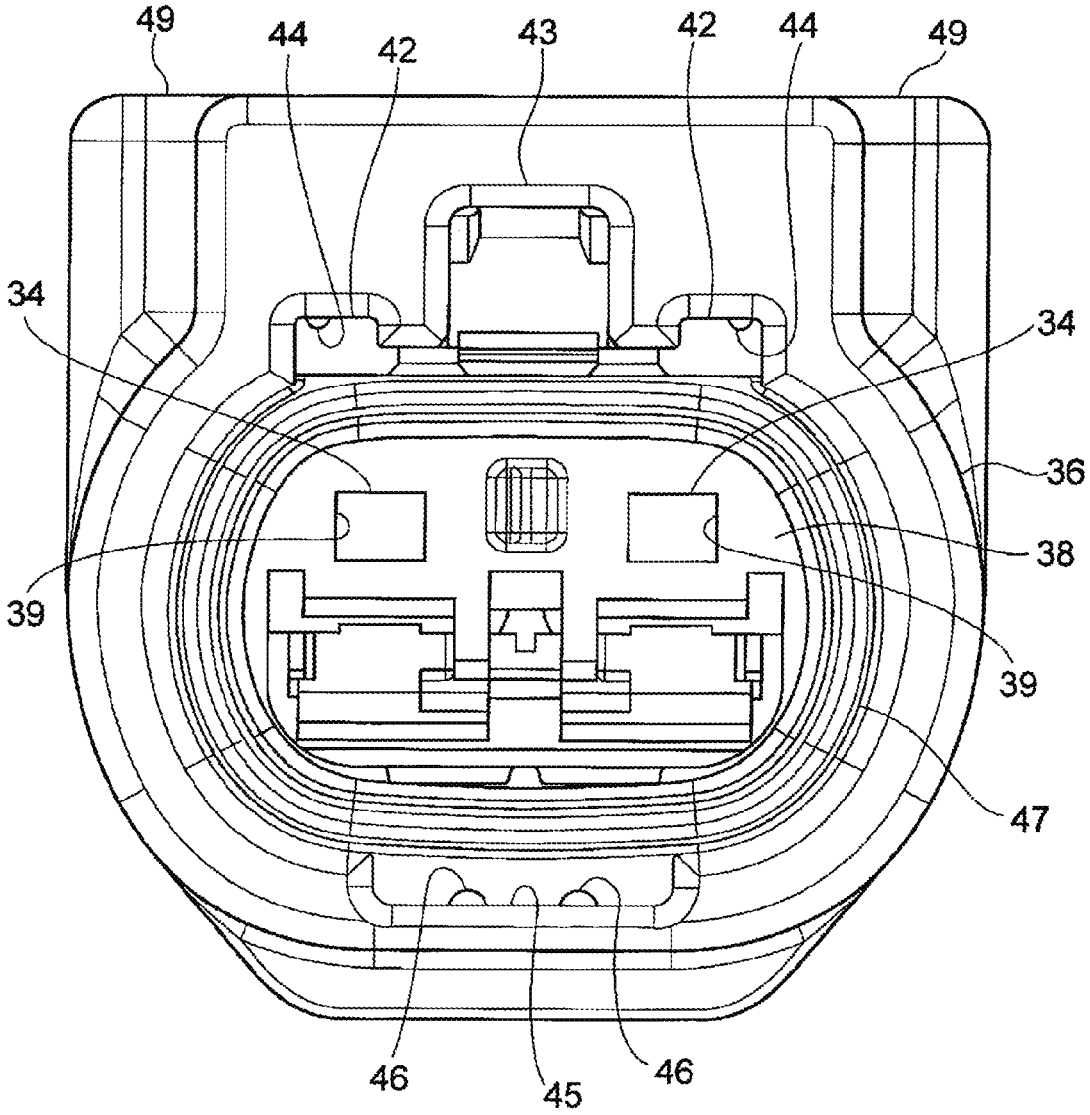
FIG. 3 is a front view illustrating a male housing when viewed from the front side.

As illustrated in FIG. 3, the cavities 34 are arranged adjacently in the width direction of the housing body 35 and are symmetrically formed to be partitioned with each other. A lance (not illustrated) extending to the front side is provided inside the cavity 34, and each male terminal 15 is locked by the lance, so as to hold each male terminal 15 at a set position in the cavity 34. The cavity 34 is open to the front side through an opening 39 of a front end surface 38 of the housing body 35 and is open to the rear side to communicate with an electric wire insertion hole 40 penetrating the electric wire holding part 37 in the front and rear direction.

The hood part 36 is formed to have a sectional shape of the inner peripheral surface nearly similar to the base part 19 of the female housing 12, so as to house the base part 19. As illustrated in FIG. 3, the hood part 36 is provided with a wall part 41 standing from the front end part. The wall part 41 includes a pair of first notch parts 42 and 42 and a second notch part 43 which is positioned inside the pair of first notch parts 42 and 42. The pair of first notch parts 42 and 42 are each formed to be continuous to the inner peripheral surface on the deep side of the hood part 36 in the front and rear direction. Third ribs 44 and 44 are each provided in the inner peripheral surface of the hood part 36 on the deep side. A guide groove 45 into which the swelling part 26 of the female housing 12 is inserted is formed in the lower portion of the inner peripheral surface of the hood part 36 to extend along from the front end of the hood part 36 to the rear end in the front and rear direction. A pair of fourth ribs 46 and 46 which project to the upper side along the front and rear direction is provided in the guide groove 45. In the hood part 36, the opening 39 of the front end surface 38 of the housing body 35 is positioned inside a cylindrical male-side tubular body 47 which is supported by the front end surface 38 and is provided to project to the front side. The male-side tubular body 47 is made of an insulating synthetic resin and is formed integrally with the housing body 35. Incidentally, a third rib 44 and a fourth rib 46 will be described in detail below.

Figure 5:
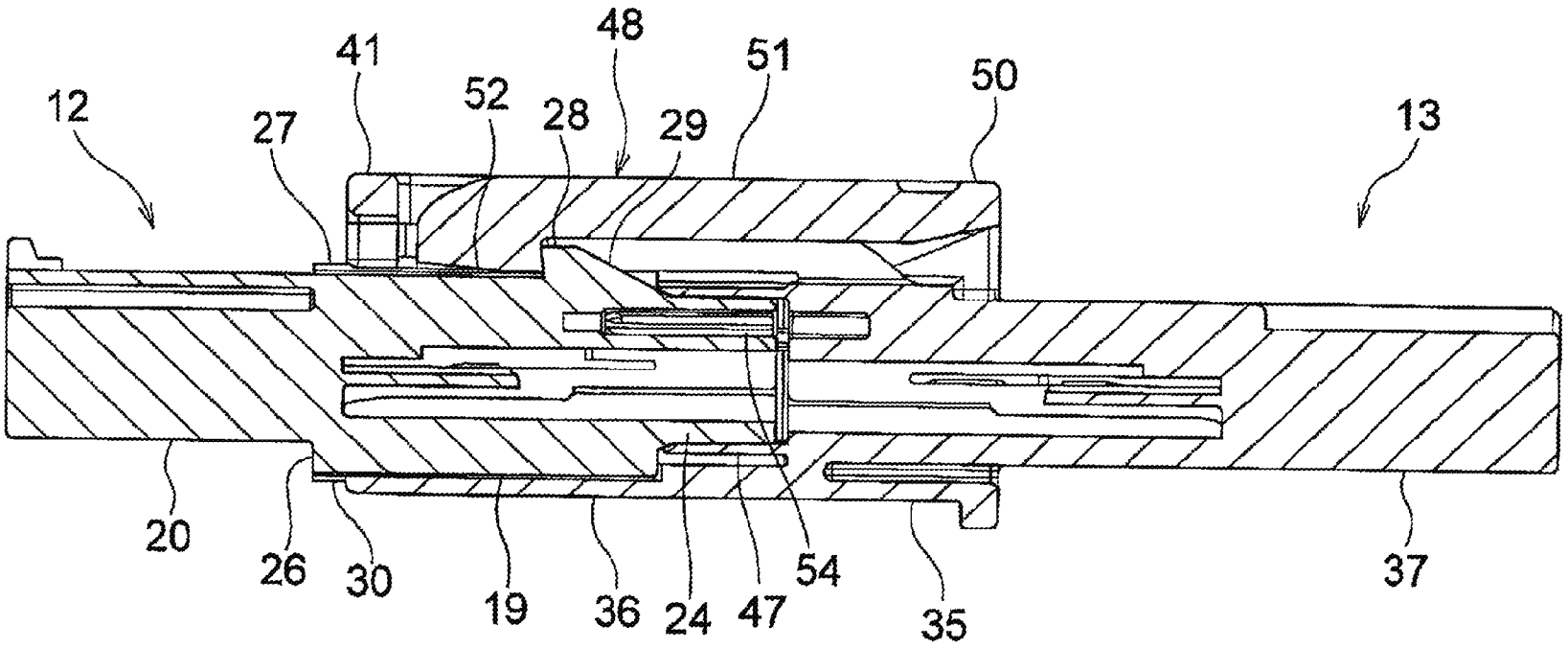
FIG. 5 is a side sectional view illustrating the connector after fitting.

A lock arm 48 of which one end part is supported and which extends to the front side along the front and rear direction is provided in the housing body 35. The lock arm 48 includes a base end part 50 which connects a pair of side wall parts 49 and 49 erected from both widthwise side surfaces of the housing body 35 in the width direction and an arm part 51 which extends to the front side from the widthwise central portion of the base end part 50. The lock arm 48 is configured such that the front end part of the arm part 51 is displaced to the upper side with respect to the horizontal direction with the base end part 50 as a fulcrum. As illustrated in FIG. 5, a lock target part 52 projecting to the lower side is provided in the front end lower portion of the arm part 51. As illustrated in FIG. 1, the pair of side wall parts 49 and 49 are provided from the housing body 35 to the wall part 41 of the hood part 36 to enclose the lock arm 48. The upper end surface of the lock arm 48 is set to be the same height as the upper end surface of the side wall part 49 or lower than the height.

As illustrated in FIG. 1, the male terminal 15 is formed of a conductive metal plate material or the like and is formed with an electric wire connection part 53 which crimps and connects the core wire of the electric wires 17 and a rod-shaped male tab 54 which is inserted into the electric contact part 32 of the female terminal 14 in an integral manner. An annular rubber plug 55 is mounted on the outer peripheral surface of the electric wires 17 of which one end is connected with the electric wire connection part 53. The male terminal 15 is inserted from the rear side to the electric wire insertion hole 40 of the electric wire holding part 37, and the rubber plug 55 is pushed into the electric wire insertion hole 40. Accordingly, the rubber plug 55 is brought into close contact with each of the outer peripheral surface of the electric wires 17 and the inner peripheral surface of the electric wire insertion hole 40, so as to seal the opening of the electric wire insertion hole 40. In the male terminal 15 which is inserted from the electric wire insertion hole 40 to be held at a predetermined position in the cavity, the male tab 54 is provided to project from the opening 39 of the front end surface 38 of the housing body 35 and to project to the front side further than the front end of the male-side tubular body 47.

Figure 4:
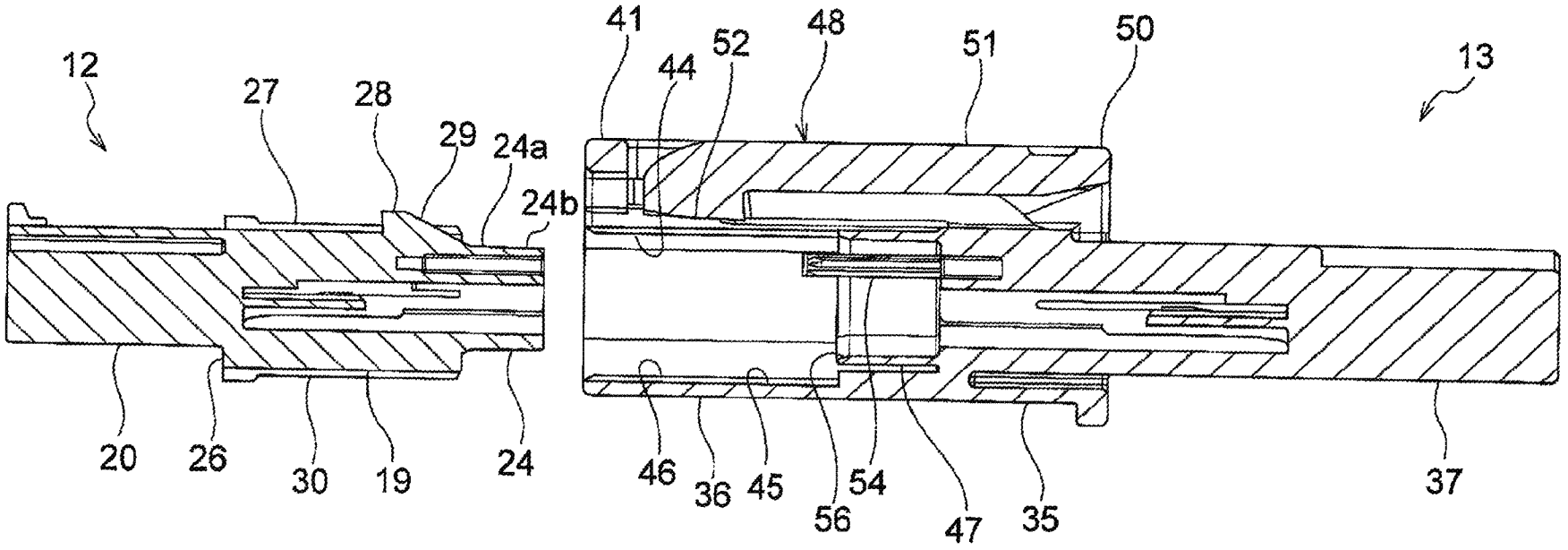
FIG. 4 is a side sectional view illustrating the connector before fitting.

Next, the waterproof structure of the cavities 18 and 34 will be described. As illustrated in FIGS. 4 and 5, the female-side tubular body 24 is configured to be inserted and fitted into the male-side tubular body 47 while fitting the female housing 12 and the male housing 13. The female-side tubular body 24 has a higher rigidity than the male-side tubular body 47 and is formed in approximately oval and cylindrical shape in which the cross section orthogonal to the front and rear direction has a longer side in the width direction. The female-side tubular body 24 is provided with a rear end part 24*a* which is formed straight over the entire periphery in the front and rear direction and a front end part 24*b* which is formed in a taper shape over the entire periphery to be tapered toward the front side. The outer peripheral surface of the rear end part 24*a* serves as a surface to be fitted with the male-side tubular body 47.

The male-side tubular body 47 is formed straight over the entire periphery in the front and rear direction, and includes an inner peripheral surface which contacts with the outer peripheral surface of the rear end part 24*a* of the female-side tubular body 24 over the entire periphery. Specifically, the inner peripheral surface of the male-side tubular body 47 is set to a size that, when the female-side tubular body 24 is inserted, the inner peripheral surface is pressed over the entire periphery by the outer peripheral surface of the female-side tubular body 24. An inclined surface 56 which spreads to the front side is formed in the tip inner peripheral surface of the male-side tubular body 47. The inclined surface 56 has a function of guiding the female-side tubular body 24 into the male-side tubular body 47. Incidentally, the projecting length from the front end surface 38 of the male-side tubular body 47 to the front side is set to be longer than the projecting length from the front end surface 21 of the female-side tubular body 24 to the front side.

Next, a basic operation of the connector while fitting will be described. First, as illustrated in FIG. 4, the female housing 12 and the male housing 13 are brought relatively close while facing each other, and the base part 19 (insertion part) of the female housing 12 is inserted into the hood part 36 (tubular part) of the male housing 13.

When the female housing 12 is inserted into the male housing 13, the pair of projection parts 25 and 25 of the female housing 12 pass through the first notch parts 42 and 42 of the male housing 13, respectively, and the lock target part 52 of the female housing 12 passes through the second notch part 43 of the male housing 13. In addition, the swelling part 26 of the female housing 12 is inserted along the guide groove 45 of the male housing 13.

Subsequently, when the female housing 12 continues to be inserted, the lock target part 52 of the lock arm 48 of the male housing 13 rides on along the inclined surface 29 of the lock part 28 of the female housing 12, so that the arm part 51 is bent and displaced to the upper side. Further, as the lock target part 52 of the arm part 51 rides over the lock part 28, the arm part 51 is elastically returned. Accordingly, the lock target part 52 is locked to the lock part 28, both housings 12 and 13 are held in a regular fitting state.

On the other hand, as illustrated in FIG. 5, when the both housings 12 and 13 are fitted, the female-side tubular body 24 is fitted in the state of being inserted to the male-side tubular body 47, and the outer peripheral surface of the female-side tubular body 24 presses the inner peripheral surface of the male-side tubular body 47 over the entire periphery. By the pressure, in the male-side tubular body 47, for example, the tip part is elastically deformed in a diameter expanding direction, and the restoring force generated by the elastic deformation presses the outer peripheral surface of the female-side tubular body 24. As a result, the female-side tubular body 24 and the male-side tubular body 47 elastically abut on each other over the entire periphery, and the clearance between the opening 22 of the female housing 12 and the opening 39 of the male housing 13 is sealed watertightly. In addition, the electric wire insertion hole 23 of the female housing 12 is sealed by the rubber plug 33, and the electric wire insertion hole 40 of the male housing 13 is sealed by the rubber plug 55. Therefore, it is possible to prevent the infiltration of water into the cavities 18 and 34. In this way, in the first embodiment, the female-side tubular body 24 and the waterproof structure formed by fitting the female-side tubular body 24 is adopted, so that a seal member or the like is not necessary, and the waterproof structure can be simplified. Thus, the connector can be reduced in size, and the cost can be reduced.

Incidentally, as in the connector 11 of the first embodiment, in the case of the connector which includes the pair of housings in which the insertion part (the base part 19 of the female housing 12) of one housing is inserted into the tubular part (the hood part 36 of the male housing 13) of the other housing to be fitted into each other, a predetermined clearance is set between the outer peripheral surface of the insertion part of one housing and the inner peripheral surface of the tubular part of the other housing to facilitate the insertion of one housing. However, when the clearance is varied to be large, looseness occurs between the housings while fitting the both housings, and when the clearance is varied to be small, the insertion load of one housing is increased, which are problematic.

Figure 6:
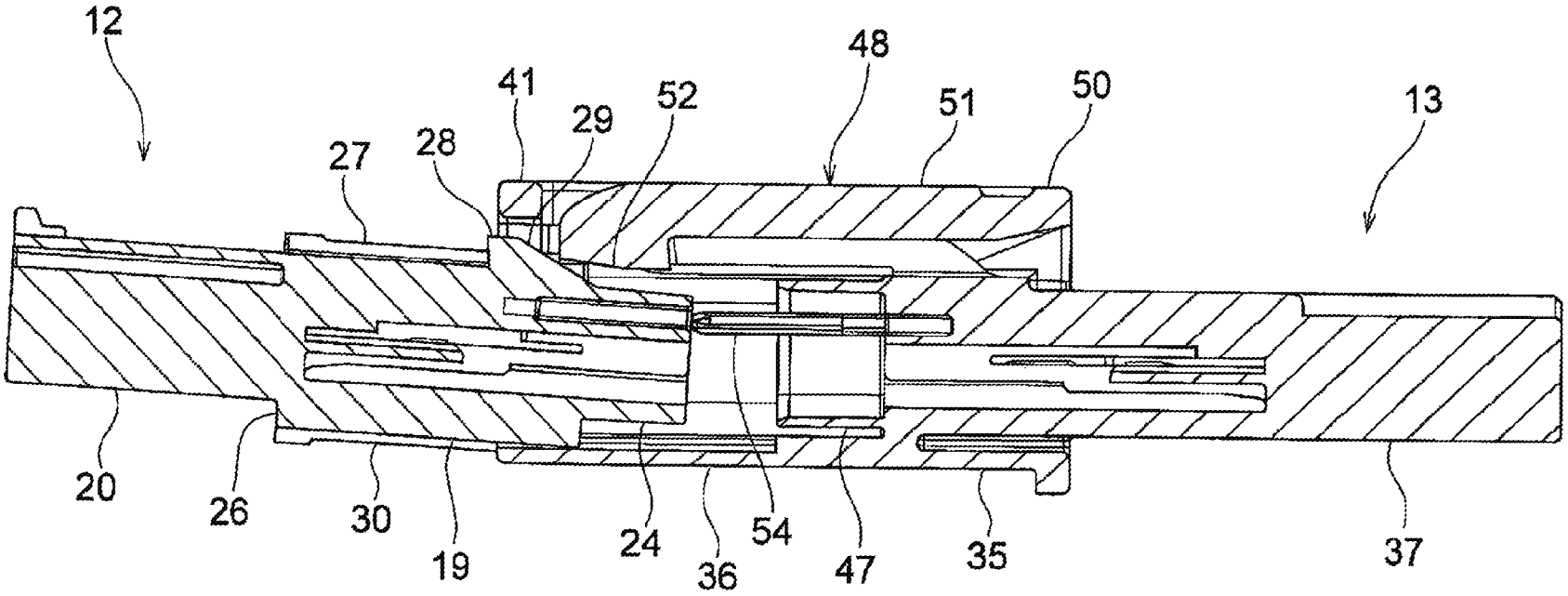
FIG. 6 is a side sectional view illustrating a state where the female housing is inserted with an inclined posture into the male housing.
Figure 7:
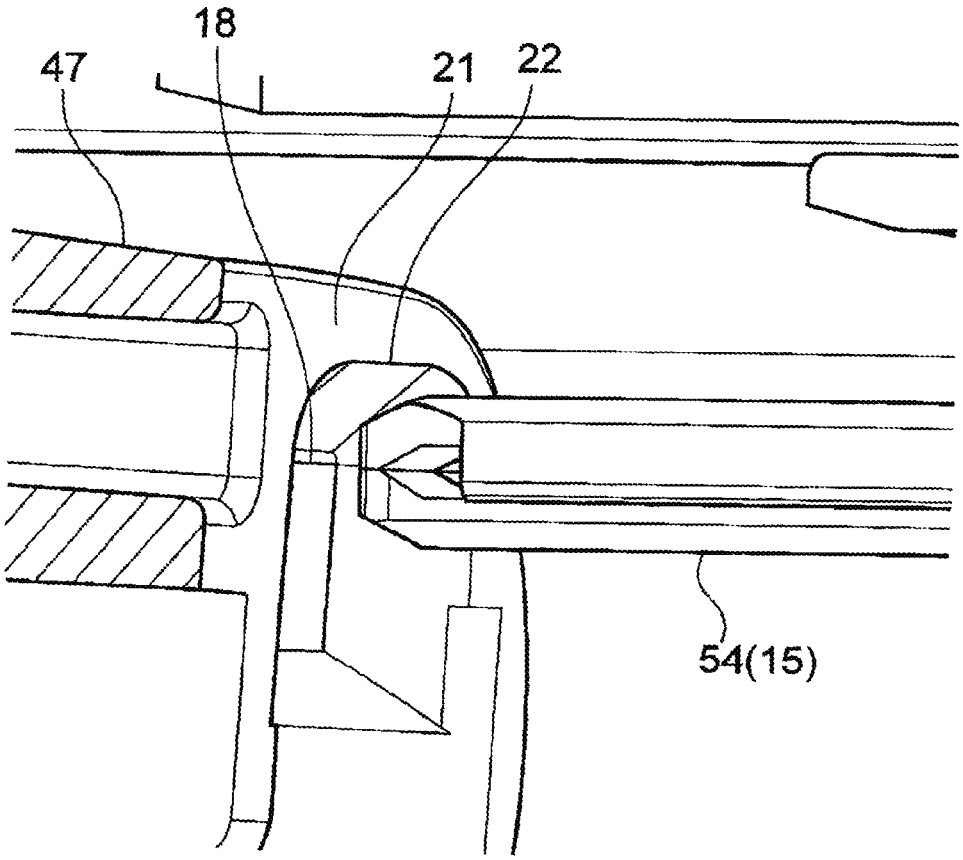
FIG. 7 is a view illustrating the enlarged interior of FIG. 6.

Depending on the clearance between the insertion part of one housing and the tubular part of the other housing, the insertion part may be inserted into the tubular part in an inclined posture. FIG. 6 is a view illustrating an initial insertion state in which the female housing 12 is inserted into the male housing 13 in an inclined posture by using the connector of the first embodiment as an example. In that case, as illustrated in FIG. 7, it is considered that the male terminal 15 cannot be picked up smoothly by the opening 22 of the cavity 18 which is formed in the front end surface 21 of the base part 19 of the female housing 12 which is an insertion part.

Figure 8:
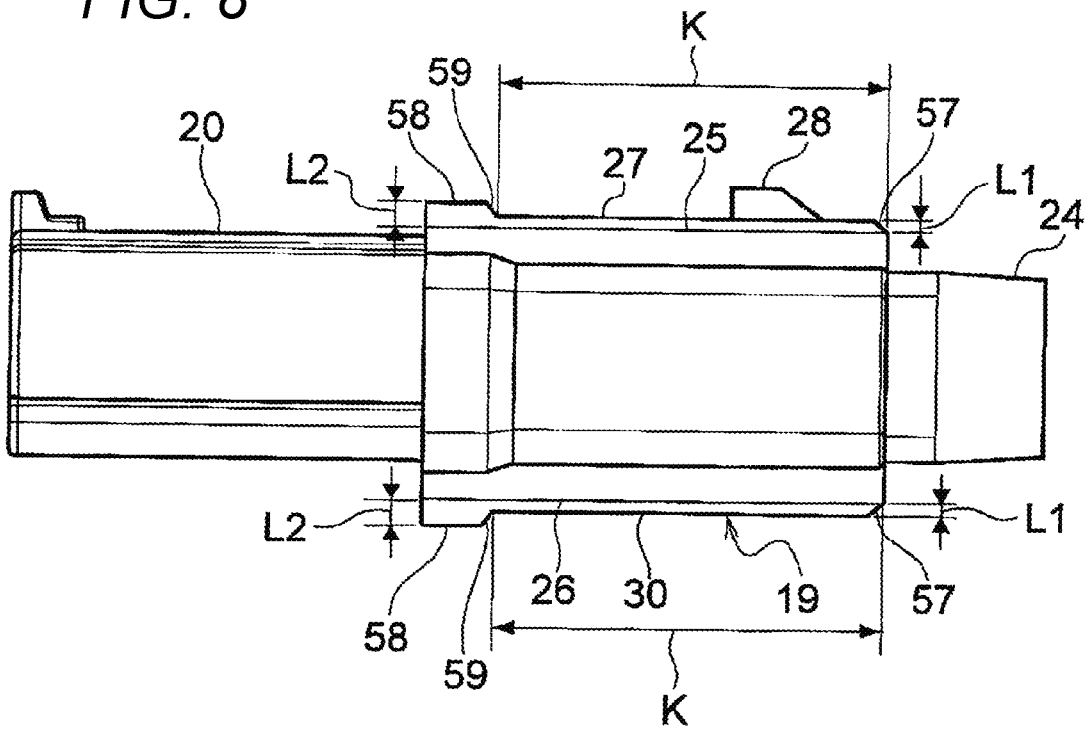
FIG. 8 is a side view of the female housing.
Figure 10:
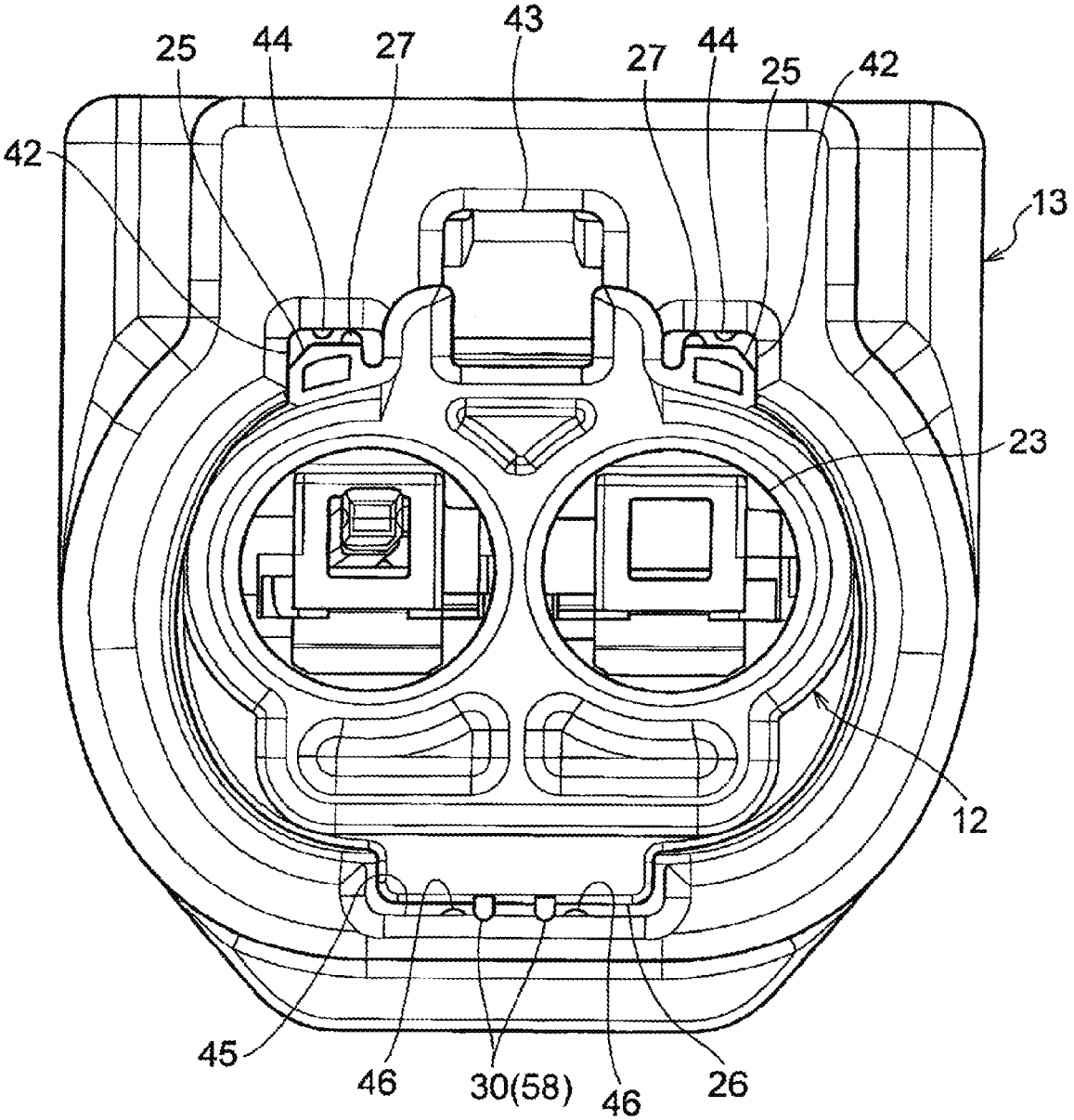
FIG. 10 is a rear view illustrating the female housing fitted into the male housing when viewed from the rear side.

Next, a rib will be described which is provided in the connector 11 of the first embodiment to cope with such a problem. As illustrated in FIGS. 8 and 10, in the outer peripheral surface of the base part 19 of the female housing 12 of the first embodiment, the pair of first ribs 27 and 27 (outer ribs) which are formed in the upper surfaces of the pair of projection parts 25 and 25 respectively and the pair of second ribs 30 and 30 (outer ribs) which are formed along the lower surface of the swelling part 26 are provided separately in a circumferential direction. The first ribs 27 and 27 each project in a stepped shape in the upper surface of the projection part 25 upward from the front end of the base part 19 to the rear end on the rear side to extend in the front and rear direction. The second ribs 30 and 30 are each provided in the lower surface of the swelling part 26 to be separated with gaps in the width direction, and project in a stepped shape downward from the front end of the base part 19 to the rear end on the rear side to extend in the front and rear direction. An inclined surface 57 of which the projection height is lowered toward the front end is formed in each front end part of the first rib 27 and the second rib 30.

In the first rib 27 and the second rib 30, the projection height from the front end of the base part 19 to a position which is separated therefrom by a set distance K is set to L1, and the projection height of a step part 58 of the position separated by the set distance K from the front end of the base part 19 to the rear end is set to a projection height L2 which is larger than the projection height L1. The projection height L1 is set to be smaller than a set value of the clearance (for example, the distance of the clearance between the lower surface of the swelling part 26 and the upper surface of the guide groove 45) (hereinafter, referred to as an appropriate clearance) between the outer peripheral surface of the base part 19 and the inner peripheral surface of the hood part 36 while fitting the base part 19 of the female housing 12 and the hood part 36 of the male housing 13, and is set to be such a height that both the first rib 27 and the second rib 30 do not contact with the inner peripheral surface of the hood part 36 while fitting the base part 19 of the female housing 12 and the hood part 36 of the male housing 13. In addition, the projection height L2 of the step part 58 is set to be the same or be larger than the set value of the clearance, and is set to a height that any step part 58 of the first rib 27 and the second rib 30 contacts with the inner peripheral surface of the hood part 36 when the base part 19 of the female housing 12 is inserted into the hood part 36 of the male housing 13. As illustrated in FIG. 8, in the step part 58 of each rib, an inclined surface 59 is provided in the front end part, and the projection height is gradually increased from the front side toward the step part 58. Sectional shapes of the first rib 27 and the second rib 30 orthogonal to the front and rear direction are a circular arc shape. However, the sectional shape may be a rectangular shape. Incidentally, the length of the step part 58 of each rib in the front and rear direction can be set considering the set distance K from the front end of the base part 19, the projection height L2 of the step part 58, and the like.

Figure 9:
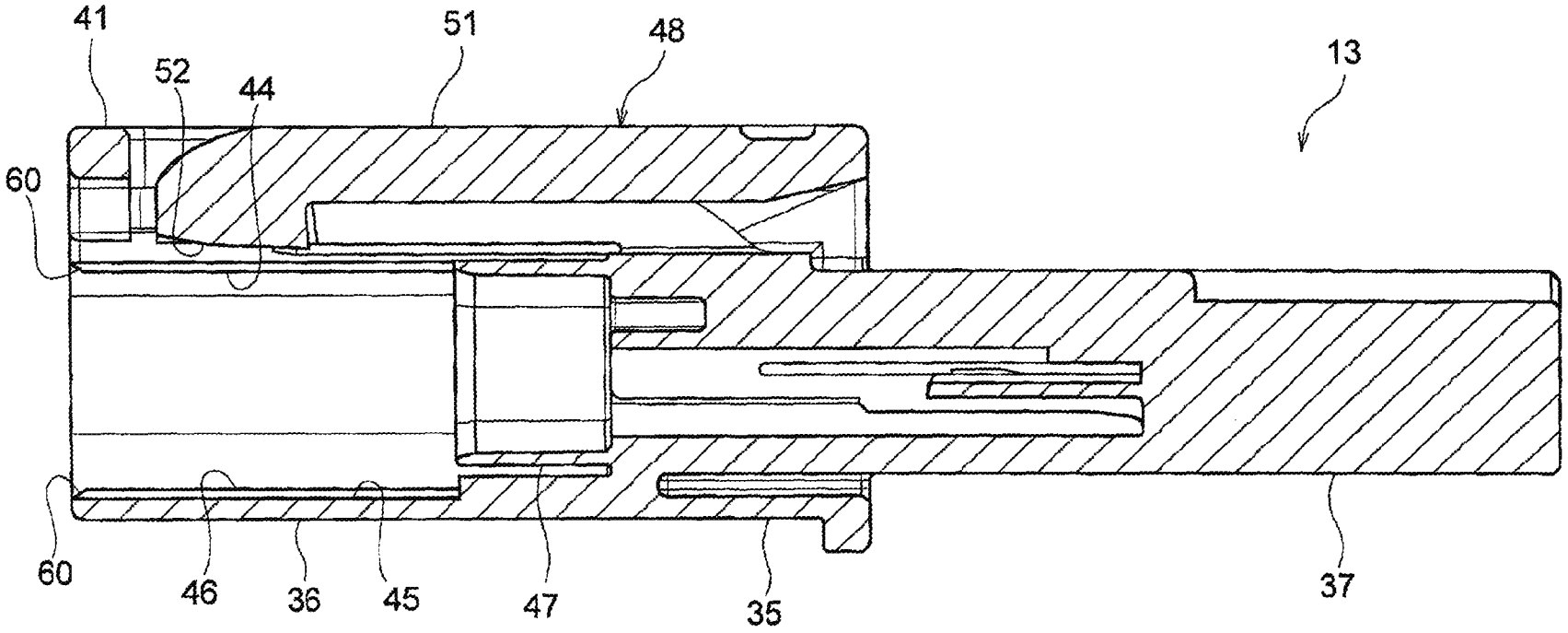
FIG. 9 is a side view of the male housing.

As illustrated in FIGS. 9 and 10, in the inner peripheral surface of the hood part 36 of the male housing 13 of the first embodiment, a pair of third ribs 44 and 44 (inner rib) which are formed continuously to the pair of first notch parts 42 and 42 along the inner peripheral surface extending to the deep side (rear side) respectively, and the pair of fourth ribs 46 and 46 (inner rib) which are formed along the upper surface of the guide groove 45 are provided separately in the circumferential direction. The third ribs 44 and 44 project in a stepped shape downward from the front end of the inner peripheral surface of the hood part 36 to the rear end on the rear side to extend in the front and rear direction. The fourth ribs 46 and 46 are provided in the upper surface of the guide groove 45 separately in the width direction, and project in a stepped shape upward from the front end of the guide groove 45 to the rear end of the rear side to extend in the front and rear direction. An inclined surface 60 of which the projection height is lowered toward the front end is formed in the front end part of the third rib 44 and the fourth rib 46.

The third rib 44 and the fourth rib 46 are set such that the projection height is uniformly equal to the projection height L1 which is smaller than the projection height L2. That is, the projection height L1 of the third rib 44 and the fourth rib 46 is set to be smaller than the set value of the clearance between the outer peripheral surface of the base part 19 and the inner peripheral surface of the hood part 36, and is set to have a height that both of the third rib 44 and the fourth rib 46 do not contact with the outer peripheral surface of the base part 19 when the base part 19 of the female housing 12 and the hood part 36 of the male housing 13 are fitted.

As illustrated in FIG. 10, the ribs are arranged such that the positions in the circumferential direction are deviated from each other while fitting the female housing 12 and the male housing 13. That is, the first rib 27 and the third rib 44 are arranged adjacently in the circumferential direction to be separated from each other in the upper portions of respective housings, and the second rib 30 and the fourth rib 46 are arranged adjacently in the circumferential direction to be separated from each other in the lower portions of respective housings. In the first embodiment, the pair of first ribs 27 and 27 are arranged inside the pair of third ribs 44 and 44. However, the pair of first ribs 27 and 27 may be arranged outside the pair of third ribs 44 and 44. In addition, in the first embodiment, the pair of second ribs 30 and 30 are arranged inside the pair of fourth ribs 46 and 46. However, the pair of second ribs 30 and 30 may be arranged outside the pair of fourth ribs 46 and 46.

Herein, when the female housing 12 is viewed from the front and rear direction, the first rib 27 and the second rib 30 of the female housing 12 are arranged at positions (specifically, symmetrically) which are plane-symmetrical to the plane passing through a geometric center (central axis) of the outer peripheral surface of the base part 19 (insertion part) of the female housing 12. When the male housing 13 is viewed from the front and rear direction, the third rib 44 and the fourth rib 46 of the male housing 13 are arranged at positions (in FIG. 10, symmetrically) which are plane-symmetrical to the plane passing through a geometric center (central axis) of the inner peripheral surface of the hood part 36 (tubular part) of the male housing 13. That is, the first to fourth ribs 27, 30, 44, and 46 are arranged to the positions which are plane-symmetrical to the plane passing through the geometric center (central axis) of the outer peripheral surface of the base part 19 (insertion part) or the inner peripheral surface of the hood part 36 (tubular part) while fitting the female housing 12 and the male housing 13. Incidentally, the positions of the ribs are not limited thereto. For example, when the female housing 12 is viewed from the front and rear direction, the first rib 27 and the second rib 30 may be arranged at positions which are point-symmetrical to the geometric center of the outer peripheral surface of the base part 19 of the female housing 12. When the male housing 13 is viewed from the front and rear direction, the third rib 44 and the fourth rib 46 may be arranged at positions which are point-symmetrical to the geometric center of the inner peripheral surface of the hood part 36 of the male housing 13. That is, the first to fourth ribs 27, 30, 44, and 46 may be arranged at the positions which are point-symmetrical to the geometric center (central axis) of the outer peripheral surface of the base part 19 (insertion part) or the inner peripheral surface of the hood part 36 (tubular part) while fitting the female housing 12 and the male housing 13. When the ribs are arranged as above, the eccentricity of the base part 19 inserted into the hood part 36 with respect to the hood part 36 can be prevented. Thus, it is possible to prevent the positional deviation between the female terminal 14 and the male terminal 15, and it is possible to maintain excellent contact between the terminals.

Figure 11:
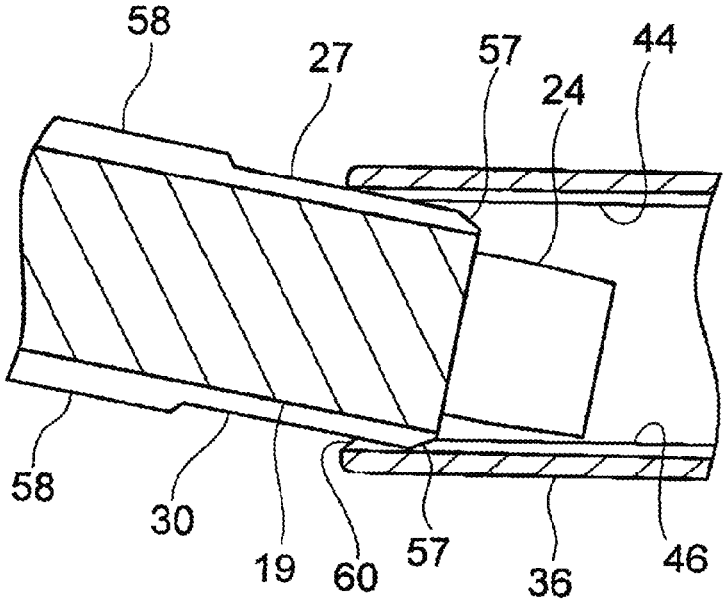
FIG. 11 is a schematic view illustrating a state where the female housing is inserted with an inclined posture into the male housing.

As described above, in the first embodiment, in the female housing 12, the first rib 27 and the second rib 30 which are outer ribs are formed to have a height same as the projection height L1 from the front end of the base part 19 to the step part 58 on the rear side. Further, in the male housing 13, the third rib 44 and the fourth rib 46 which are inner ribs are provided to have a height same as the projection height L1 from the front end of the hood part 36 to the rear side. Therefore, for example, as illustrated in FIG. 11, in a case where the base part 19 of the female housing 12 is inserted in an inclined posture (downward) into the hood part 36 of the male housing 13, the outer peripheral surface of the base part 19 abuts on the fourth rib 46, and the first rib 27 of the base part 19 abuts on the inner peripheral surface of the hood part 36, so as to correct the inclination of the base part 19 at an initial insertion stage. Accordingly, the male terminal 15 can be picked up smoothly by the opening 22 of the front end surface 21 of the base part 19, and the female-side tubular body 24 and the male-side tubular body 47 can be fitted at an appropriate angle.

Figure 12:
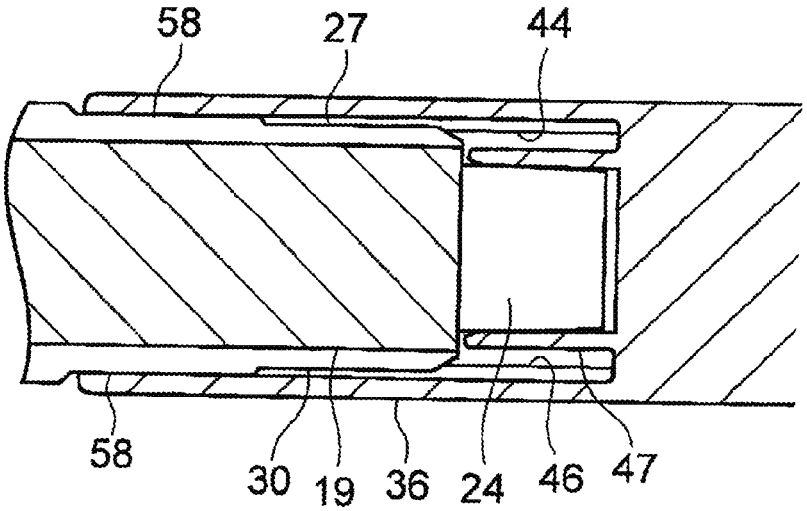
FIG. 12 is a schematic view illustrating a state where the female housing is inserted into the male housing.

Here, the projection height L1 of each rib is set smaller than the set value of the clearance between the outer peripheral surface of the base part 19 and the inner peripheral surface of the hood part 36. Accordingly, as illustrated in FIG. 12, a clearance can be provided between each rib and the inner peripheral surface of the hood part 36 or the outer peripheral surface of the base part 19, and the increase of the insertion load while inserting the base part 19 into the hood part 36 can be prevented. In addition, the inclined surface 57 is formed in each front end part of the first rib 27 and the second rib 30, and the inclined surface 60 is formed in each front end part of the third rib 44 and the fourth rib 46. Accordingly, the posture of the base part 19 of the female housing 12 can be corrected smoothly along the inclined surfaces 57 and 60. In addition, the ribs are arranged such that the positions in the circumferential direction are deviated from each other. In this regard, the contact between the ribs while inserting the base part 19 can be prevented, and the degree of freedom in designing the length of each rib in the front and rear direction can be secured.

In the first embodiment, the projection height of the third rib 44 and the fourth rib 46 are set to be the same as the projection height L1 of the first rib 27 and the second rib 30. However, when the projection height of the third rib 44 and the fourth rib 46 is smaller than the projection height L2, the projection height may be set to be the projection height different from the projection height L1.

In the first embodiment, when the base part 19 of the female housing 12 is inserted into the hood part 36 of the male housing 13, the step part 58 of the first rib 27 and the step part 58 of the second rib 30 which project from the outer peripheral surface of the base part 19 are each inserted into the hood part 36. Accordingly, although the clearance between the outer peripheral surface of the base part 19 and the inner peripheral surface of the hood part 36 is not set small, the clearance can be minimized by inserting the step part 58 of each rib. Accordingly, it is possible to prevent the looseness between the housings while fitting the female housing 12 and the male housing 13. In addition, in the base part 19 of the female housing 12, each rib is provided to limit the contact area with the inner peripheral surface of the hood part 36, and the step parts 58 of the first rib 27 and the second rib 30 are provided to the rear side from the position which is separated by the set distance K from the front end of the base part 19. Accordingly, it is possible to prevent the increase of the insertion load while inserting the base part 19 into the hood part 36.

Herein, in the first rib 27 and the second rib 30, in a case where the projection height L2 of the step parts 58 of each rib is set larger than the set value of the clearance between the outer peripheral surface of the base part 19 and the inner peripheral surface of the hood part 36, the step part 58 inserted into the hood part 36 pushes the inner peripheral surface of the hood part 36. However, the inclined surface 59 is formed in the front end part of each step part 58, and the inner peripheral surface of the hood part 36 pushed by the step part 58 is limited to a part of the tip side, thereby preventing the increase of the insertion force. In addition, the projection height L2 of the step parts 58 of each rib can be set smaller than the set value of the clearance. In that case, the clearance cannot be minimized. However, since the projection height L2 is set larger than the projection height L1, the clearance can be reduced further, and when the set distance K is shortened to adjust the length of the step part 58 in the front and rear direction, the looseness between the housings can be controlled sufficiently. Incidentally, the step parts 58 are provided in the first rib 27 and the second rib 30. However, instead thereof or together therewith, similarly, also in the third rib 44 and the fourth rib 46, step parts of the projection height K2 can be provided to the rear side from the position separated by the set distance K rearward from the front end of the hood part 36.

Preferably, the set distance K is set to a length that the step part 58 is inserted into the hood part 36 before the female-side tubular body 24 and the male-side tubular body 47 start to be fitted. Thus, when the step part 58 is inserted into the hood part 36, the base part 19 can be positioned to the hood part 36. Accordingly, the positional deviation of the female-side tubular body 24 and the male-side tubular body 47 can be prevented to secure an excellent waterproofness.

In the first embodiment, the first rib 27 and the second rib 30 are provided in the outer peripheral surface of the base part 19, and the third rib 44 and the fourth rib 46 are provided in the inner peripheral surface of the hood part 36. However, for example, only one of the first rib 27 and the second rib 30 may be provided in the outer peripheral surface of the base part 19, and only one of the third rib 44 and the fourth rib 46 may be provided in the inner peripheral surface of the hood part 36. The number of the ribs is not limited particularly. In addition, as in the first embodiment, the circumferential positions where the ribs are provided are set in the vertical direction of the connector 11 in the fitted state of the female housing 12 and the male housing 13. That is, the first rib 27 and the third rib 44 are provided in the upper portion of the connector 11 near both sides in the width direction of the lock arm 48, and the second rib 30 and the fourth rib 46 are provided in the lower portion of the connector 11. However, the invention is not limited thereto. For example, the ribs can be each provided in the width direction (right and left direction) of the outer peripheral surface of the base part 19 and the inner peripheral surface of the hood part 36.

Hereinafter, other embodiments of the connector according to the invention will be described. However, all the other embodiments are basically the same as the first embodiment. Therefore, the following describes only characteristic configuration of the embodiments, and the configuration common to the first embodiment is omitted.

Second Embodiment

Figures 13A, 13B:
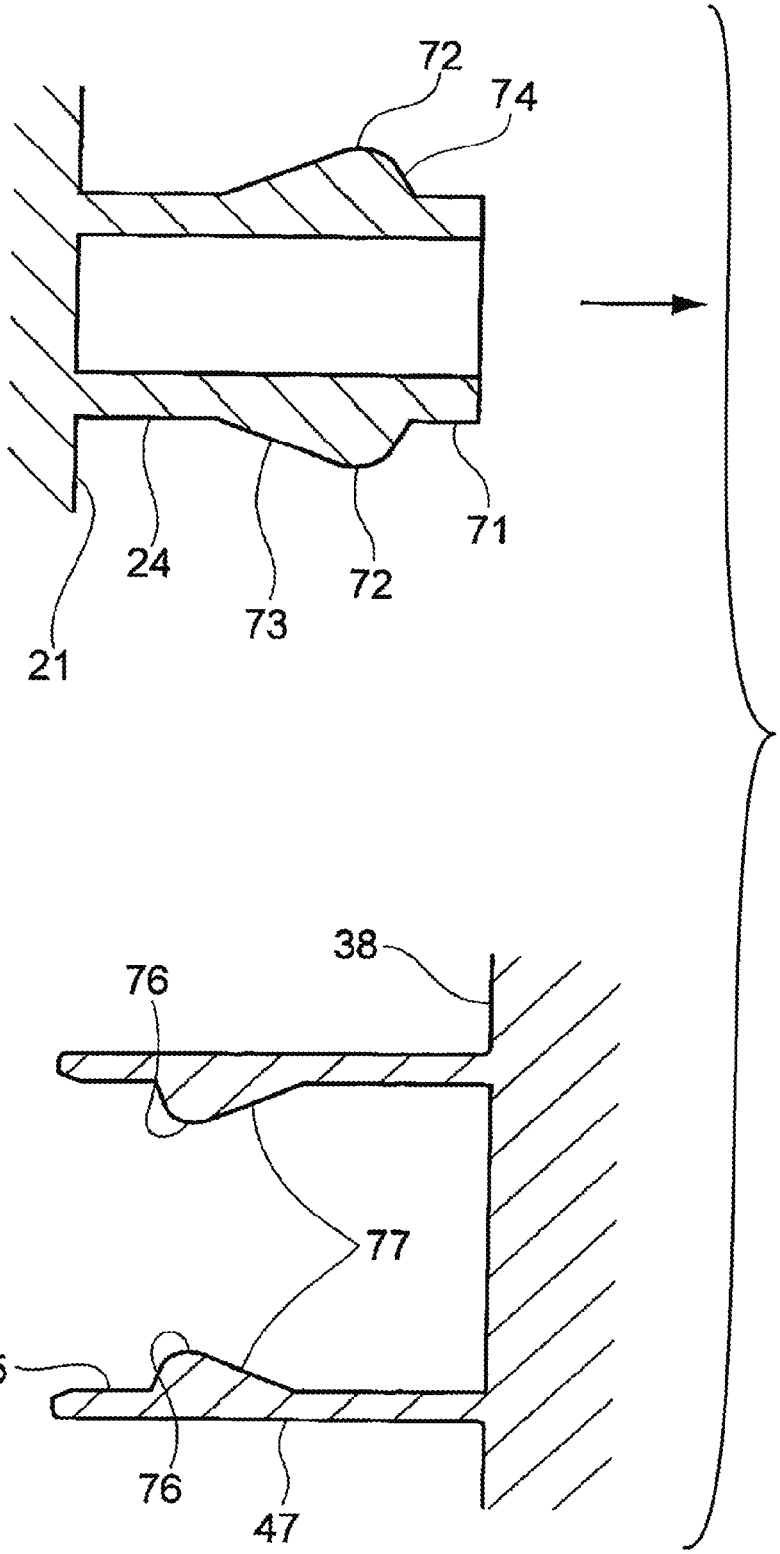

A second embodiment is different from the first embodiment as follows. As illustrated in FIG. 13A, in the waterproof structure formed by fitting the female-side tubular body 24 and the male-side tubular body 47, an annular protrusion 72 which contacts with the facing surface (not illustrated) of the male-side tubular body 47 is provided over the entire periphery in a facing surface 71 of the female-side tubular body 24 of the facing surfaces of the female-side tubular body 24 and the male-side tubular body 47, and an inclined surface 73 of which the projection height is lowered from the front end side of the female-side tubular body 24 toward the rear end side is formed in the annular protrusion 72.

In the second embodiment, the annular protrusion 72 is provided in the facing surface 71 of the female-side tubular body 24. Thus, when the female-side tubular body 24 and the male-side tubular body 47 are fitted to each other, the annular protrusion 72 is pushed against the facing surface of the male-side tubular body 47. Accordingly, the sealability can be improved while preventing the increase of the insertion force of the female-side tubular body 24, and the waterproofness of the cavities 18 and 34 by the female-side tubular body 24 and the male-side tubular body 47 can be improved.

However, the annular protrusion 72 is provided in a pulling-out direction of the mold during resin molding, and thus, the annular protrusion 72 is easily caught by the mold during mold release.

In this point, in the annular protrusion 72 of the second embodiment, the top portion is formed in an R surface, and the cross section is formed in a triangle shape. The inclined surface 73 directed to the rear side includes a taper-shaped annular surface gentler to the facing surface 71 than an inclined surface 74 directed to the front side and is formed such that the projection height is continuously lowered from the top portion of the annular protrusion 72 toward the facing surface 71. As the annular protrusion 72 includes the inclined surface 73 of which the projection height is continuously lowered from the front end side of the female-side tubular body 24 toward the rear end side, in a case where the mold is released in a direction of the arrow during resin molding, the mold can be pulled out along the inclined surface 73. As a result, the mold is prevented from being caught by the annular protrusion 72 to maintain the shape of the annular protrusion 72. Incidentally, when the mold moves along the inclined surface 73, the female-side tubular body 24 is elastically deformed in a diameter reducing direction. However, when the mold is released completely, the female-side tubular body 24 is restored to the original state.

As illustrated in FIG. 13B, in a case where an annular protrusion 76 which contacts with the facing surface (not illustrated) of the female-side tubular body 24 is provided over the entire periphery in a facing surface 75 of the male-side tubular body 47 instead of the female-side tubular body 24, an inclined surface 77 of which the projection height is continuously lowered from the front end side of the male-side tubular body 47 toward the rear end can be formed in the annular protrusion 76. Thus, in a case where the mold is released in the direction of the arrow during resin molding, the mold can be pulled out along the inclined surface 77. As a result, the mold is prevented from being caught by the annular protrusion 76 to maintain the shape of the annular protrusion 76.

Third Embodiment

Figures 14A, 14B:
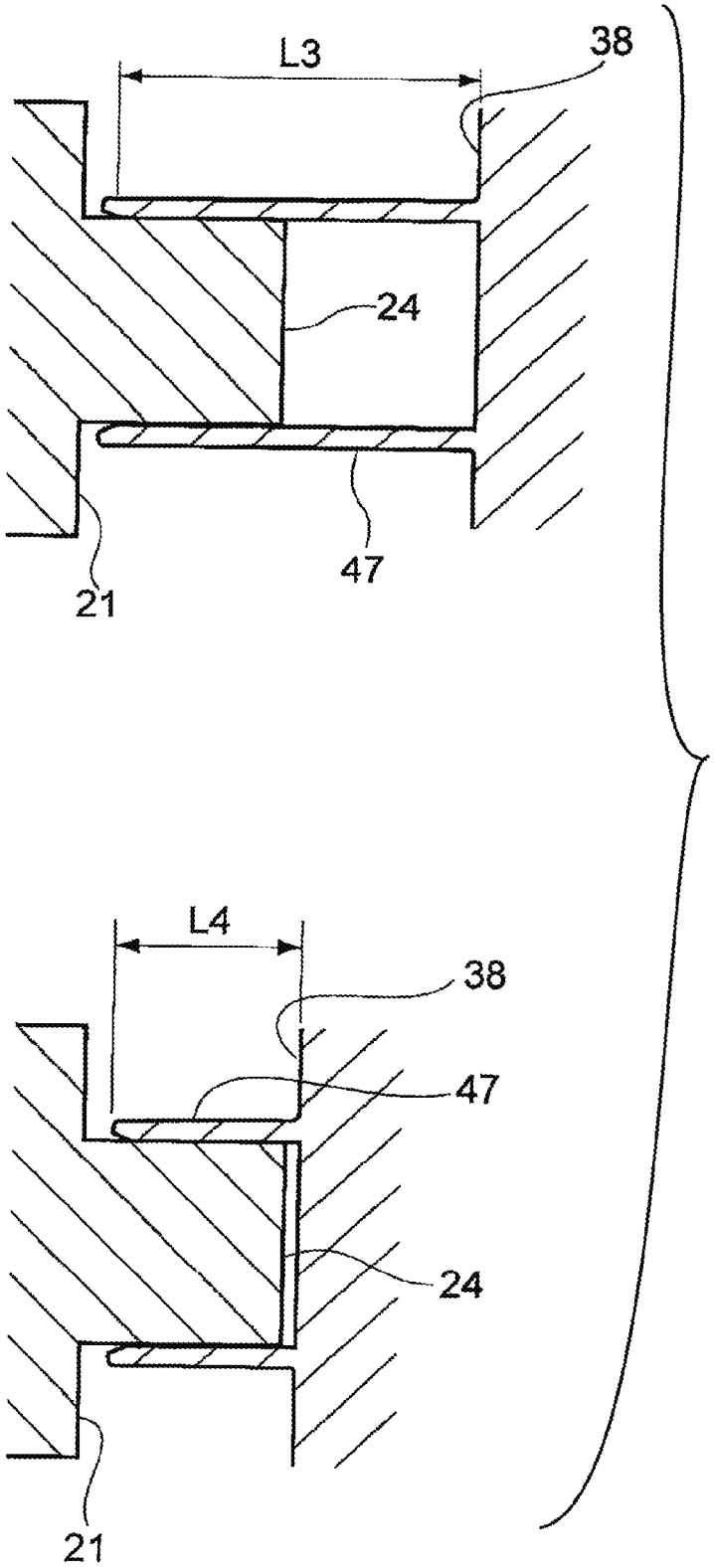

A third embodiment is different from the first embodiment as follows. In the waterproof structure formed by fitting the female-side tubular body 24 and the male-side tubular body 47, only the projecting length of the male-side tubular body 47 to the front side is lengthened. FIGS. 14A and 14B are views illustrating a state where the female-side tubular body 24 and the male-side tubular body 47 are fitted. In FIGS. 14A and 14B, the projecting length of the female-side tubular body 24 to the front side is the same as a length (lap length) in the front and rear direction where the outer peripheral surface of the female-side tubular body 24 contacts with the inner peripheral surface of the male-side tubular body 47.

As illustrated in FIG. 14A, a projecting length L3 of the male-side tubular body 47 to the front side is set longer than a projecting length L4 of the male-side tubular body 47 to the front side illustrated in FIG. 14B. Thus, the female-side tubular body 24 can be brought into contact with the tip part of the male-side tubular body 47. That is, in the male-side tubular body 47, a restraining force in the diameter expanding direction is smaller toward the tip. Thus, when the lap region where the outer peripheral surface of the female-side tubular body 24 contacts with the inner peripheral surface of the male-side tubular body 47 is positioned closer to the tip of the male-side tubular body 47, the insertion force of inserting the female-side tubular body 24 to the male-side tubular body 47, that is, the insertion force of inserting the female housing 12 to the male housing 13 can be reduced further. Incidentally, in the third embodiment, the lap length of the female-side tubular body 24 and the male-side tubular body 47 is maintained. Thus, it is possible to maintain the waterproofness by the female-side tubular body 24 and the male-side tubular body 47.

Herein, preferably, a ratio (lap ratio) of the lap length of the female-side tubular body 24 and the male-side tubular body 47 to the projecting length L3 of the male-side tubular body 47 to the front side is less than 50%, for example.

Incidentally, the invention is not limited to the above-described embodiment but may be modified or improved appropriately. In addition, material, shape, size, number, location or the like of each component in the above-described embodiments are arbitrary and not limited as long as they can attain the invention.

Herein, the features of the embodiments of the connector according to the invention will be simply summarized as follows.

[1] A connector (11) including:

a pair of housings (female housing 12 and male housing 13) to be fitted to each other by inserting an insertion part (base part 19) of one housing (female housing 12) into a tubular part (hood part 36) of another housing (male housing 13), wherein on an outer peripheral surface of the insertion part (base part 19) of the one housing (female housing 12), a plurality of outer ribs (first rib 27 and second rib 30) which project from the outer peripheral surface are provided separately in a circumferential direction to extend from a front end of the insertion part (base part 19) to a rear side, wherein on an inner peripheral surface of the tubular part (hood part 36) of the other housing (male housing 13), a plurality of inner ribs (third rib 44 and fourth rib 46) which project from the inner peripheral surface are provided separately in a circumferential direction to extend from a front end of the tubular part (hood part 36) to a rear side, and wherein the outer ribs (first rib 27 and second rib 30) and the inner ribs (third rib 44 and fourth rib 46) are provided such that positions in the circumferential direction are deviated from each other.

[2] The connector (11) according to [1], wherein the outer ribs (first rib 27 and second rib 30) are arranged at positions which are plane-symmetrical to a plane passing through a geometric center of the outer peripheral surface of the insertion part (base part 19), and wherein the inner ribs (third rib 44 and fourth rib 46) are arranged at positions which are plane-symmetrical to a plane passing through a geometric center of the inner peripheral surface of the tubular part (hood part 36).

[3] The connector (11) according to [1] or [2], wherein the outer ribs (first rib 27 and second rib 30) are formed in a stepped shape having an increased projection height from a position separated by a set distance from the front end of the insertion part (base part 19) to the rear side, or the inner ribs (third rib 44 and fourth rib 46) are formed in a stepped shape having an increased projection height from a position separated by a set distance from the front end of the tubular part (hood part 36) to the rear side.

[4] The connector (11) according to any one of [1] to [3], wherein the pair of housings (female housing 12 and male housing 13) include: cavities (18, 34), each of which houses a terminal (female terminal 14 and male terminal 15); and a pair of resin tubular bodies (female-side tubular body 24 and male-side tubular body 47) which are supported by the housings (female housing 12 and male housing 13) such that openings (22, 39) of the cavities (18, 34) are positioned inside the tubular bodies and which are fitted to each other, wherein an annular protrusion (72 or 76) is provided over an entire periphery on one surface (facing surface 71 or facing surface 75) of surfaces of the pair of tubular bodies (female-side tubular body 24 and male-side tubular body 47) which face each other when the pair of tubular bodies (female-side tubular body 24 and male-side tubular body 47) are fitted, and contacts another surface of the surfaces, and wherein the annular protrusion (72 or 76) includes an inclined surface (73 or 77) which is lowered from a front end side of the tubular body (female-side tubular body 24 and male-side tubular body 47) toward a rear end side.

According to the connector of the embodiment of the invention, the operability in connector fitting can be improved by controlling the inclination of the housing during insertion.

The invention claimed is:

1. A connector comprising:

a pair of housings to be fitted to each other by inserting an insertion part of one housing into a tubular part of another housing, wherein on an outer peripheral surface of the insertion part of the one housing, a plurality of outer ribs which project from the outer peripheral surface are provided separately in a circumferential direction to extend from a front distal end of the insertion part to a rear side, wherein on an inner peripheral surface of the tubular part of the other housing, a plurality of inner ribs which project from the inner peripheral surface are provided separately in a circumferential direction to extend from a front distal end of the tubular part to a rear side, wherein the plurality of outer ribs are provided, on the outer peripheral surface of the insertion part, at a center portion of a lower portion in a width direction, a portion closer to one side of the width direction than a center portion of the upper portion in the width direction, and a portion closer to the other side of the width direction than the center portion of the upper portion, wherein the plurality of inner ribs are provided, on the inner peripheral surface of the tubular part, at a center portion of a lower portion in a width direction, a portion closer to one side of the width direction than a center portion of the upper portion in the width direction, and a portion closer to the other side of the width direction than the center portion of the upper portion, wherein in a state in which the pair of housings are fitted, all of the outer ribs and the inner ribs corresponding to each other are arranged adjacently in the circumferential direction, and wherein the adjacent outer ribs and the inner ribs are provided such that positions in the circumferential direction are deviated from each other, wherein the plurality of outer ribs which project from the outer peripheral surface are provided separately in the circumferential direction to extend from the front distal end of the insertion part to a rear end of the insertion part.

2. The connector according to claim 1, wherein the outer ribs are arranged at positions which are plane-symmetrical to a plane passing through a geometric center of the outer peripheral surface of the insertion part, and wherein the inner ribs are arranged at positions which are plane-symmetrical to a plane passing through a geometric center of the inner peripheral surface of the tubular part.

3. The connector according to claim 1, wherein the outer ribs are formed in a stepped shape having an increased projection height from a position separated by a set distance from the front end of the insertion part to the rear side, or the inner ribs are formed in a stepped shape having an increased projection height from a position separated by a set distance from the front end of the tubular part to the rear side.

4. The connector according to claim 1, wherein the pair of housings comprise: cavities, each of which houses a terminal; and a pair of resin tubular bodies which are supported by the housings such that openings of the cavities are positioned inside the tubular bodies and which are fitted to each other, wherein an annular protrusion is provided over an entire periphery on one surface of surfaces of the pair of tubular bodies which face each other when the pair of tubular bodies are fitted, and contacts another surface of the surfaces, and wherein the annular protrusion comprises an inclined surface which is lowered from a front end side of the tubular body toward a rear end side.

* * * * *